US005263615A

United States Patent [19]

Anderson et al.

[11] Patent Number: 5,263,615

[45] Date of Patent: Nov. 23, 1993

[54] LIQUID APPLICATOR BOTTLE

[75] Inventors: Lane J. Anderson; Richard L. George, both of Englewood; W. Kenn Thiess, Aurora; Patrick J. Tighe; Reed N. Wilcox, both of Littleton, all of Colo.

[73] Assignee: Polymerics, Inc., Natick, Mass.

[21] Appl. No.: 861,562

[22] Filed: Apr. 1, 1992

[51] Int. Cl.[5] ..... B65D 37/00

[52] U.S. Cl. ..... 222/212; 222/551

[58] Field of Search ..... 222/212, 420, 562, 569, 222/551

[56] References Cited

U.S. PATENT DOCUMENTS

| | | | |
|---|---|---|---|
| D. 37,819 | 2/1906 | Bradley . | |
| D. 64,135 | 3/1924 | Schwenck . | |
| D. 86,629 | 3/1932 | Nitardy . | |
| D. 103,065 | 2/1937 | Fuerst . | |
| D. 165,734 | 1/1952 | Barton . | |
| D. 167,637 | 9/1952 | Knight . | |
| D. 196,082 | 8/1963 | Stull . | |
| D. 200,447 | 2/1965 | Lermer . | |
| D. 237,700 | 4/1978 | Garazi | D9/143 |
| D. 259,181 | 5/1981 | Saenz | D9/389 |
| D. 280,492 | 9/1985 | Greaves et al. | D9/453 |
| D. 282,443 | 2/1986 | Beaver et al. | D9/408 |
| D. 282,640 | 2/1986 | Beaver et al. | D9/403 |
| D. 318,423 | 7/1991 | Kipperman et al. | D9/403 |
| D. 318,621 | 7/1991 | Venne | D9/453 |
| 2,261,310 | 11/1941 | Sullivan . | |
| 2,673,661 | 3/1954 | Barton | 222/569 X |
| 2,684,789 | 7/1954 | Marchant | 222/212 |
| 2,734,665 | 2/1956 | Flamm | 222/212 |
| 2,987,223 | 6/1961 | Armour | 222/420 X |
| 3,146,919 | 9/1964 | Chappell | 222/212 |
| 3,197,071 | 7/1965 | Kuster | 222/145 |
| 3,948,704 | 4/1976 | Evans | 222/94 |
| 4,089,437 | 5/1978 | Chutter et al. | 222/94 |
| 4,099,651 | 7/1978 | von Winckelmann | 222/94 |
| 4,148,417 | 4/1979 | Simmons | 222/94 |
| 4,498,609 | 2/1985 | Stock | 222/420 |
| 4,771,919 | 9/1988 | Ernst | 222/145 |
| 4,964,539 | 10/1990 | Mueller | 222/145 |
| 5,038,963 | 8/1991 | Pettengill et al. | 222/145 |
| 5,056,689 | 10/1991 | Heyl et al. | 222/420 X |
| 5,102,016 | 4/1992 | Ball et al. | 222/145 |
| 5,105,993 | 4/1992 | La Haye et al. | 222/420 X |

FOREIGN PATENT DOCUMENTS

| | | | |
|---|---|---|---|
| 1023317 | 12/1977 | Canada | 222/94 |
| 1396382 | 2/1964 | France | 222/94 |

*Primary Examiner*—Andres Kashnikow
*Assistant Examiner*—Kenneth Bomberg
*Attorney, Agent, or Firm*—Wolf, Greenfield & Sacks

[57] ABSTRACT

A liquid applicator bottle for holding and applying liquids, such as fabric paint, to surfaces is formed of a resiliently deformable hollow body. The bottle has a base at one end and sloped shoulders at the other end. The shoulders are angled toward each other to form a neck having an opening. A nozzle unit with a substantially cylindrical stem, sharply tapered to a flange, and having a passage therethrough, is mounted in the opening of the neck. The stem extends axially and outwardly from the flange, which is retained within the neck. A cap is removably mountable on the neck, in a covering relationship to the nozzle unit.

13 Claims, 3 Drawing Sheets

LIQUID APPLICATOR BOTTLE

BACKGROUND OF THE INVENTION

1. Field of the Invention:

The present invention pertains to a bottle for applying liquid, such as paint, to create designs on cloth and other surfaces.

2. Description of the Prior Art:

Fabric paint, and other liquids for creating designs on cloth and other surfaces, are typically stored in bottles that can be held comfortably in the hand. Conventional methods for applying fabric paint involve the use of brushes, sprays, or squeeze bottles or tubes.

While many applicators have been available in the prior art, they do not allow the user to create fine detailing and intricate designs, and frequently do not provide a smooth flow of fabric paint. For example, the numerous bristles of conventional fabric brushes may catch on the threads of a piece of fabric, making precise application difficult. Furthermore, while air brushes or spray guns provide a continuous supply of paint, such devices are generally expensive, require skill to operate, and also fail to provide a means for precise application of paint to create a detailed design.

To overcome the drawbacks of brushes and spray guns, the application of paint directly from a bottle has become popular. Such bottles are provided with a thin nozzle so that paint is emitted in a fine line, enabling precise application. The bottles are made from resilient material allowing the user to apply manual pressure and vary the flow of paint according to his/her design.

The use of such bottles, however, may also have several disadvantages. Often, these paint bottles are uncomfortable in a user's hand, due to their circular cross-section. Such bottles are generally palmed by the user and therefore cannot easily be held with the nozzle positioned for precise application. As a result, the use of these bottles for direct application of fabric paint to create detailed designs is impractical. Furthermore, the body of the bottle typically blocks the user's line of sight to the tip of the nozzle. Lastly, paint flow from a bottle may be turbulent, due to liquid build-up and/or air pockets caused by the bottle's structure, which typically has an abruptly projecting nozzle from the body of the bottle. This problem contributes to the imprecise application of the liquid onto a surface.

SUMMARY OF THE INVENTION

According to the present invention, a liquid applicator bottle is formed of a resiliently deformable hollow body adapted to hold a liquid and having a base at one end and sloped shoulders at the other end. The shoulders are angled toward each other, forming a neck having an opening. A nozzle unit, having a passage therethrough, is mounted in the opening of the neck. The nozzle unit comprises two primary portions: a substantially cylindrical stem which is sharply tapered, and a flange. The stem extends axially and outwardly from the flange, which is retained within the opening of the neck. Lastly, a cap is removably mountable on the neck, in a covering relationship to the nozzle unit.

It is an object of the invention to provide a new and improved liquid applicator bottle for fabric paint and other liquids. Other objects of the invention are to provide a liquid applicator bottle which provides user comfort, and smooth liquid flow which may be used for detailed design applications.

Other objects and features of the present invention will become apparent from the following detailed description when taken in connection with the accompanying drawings which disclose a preferred embodiment of the invention. It is to be understood that the drawings are designed for the purpose of illustration only and are not intended as a definition of the limits of the invention.

BRIEF DESCRIPTION OF THE DRAWINGS

The foregoing and other objects and advantages of the invention will be appreciated more fully from the following drawings in which.

DETAILED DESCRIPTION OF THE INVENTION

Figure 1A:
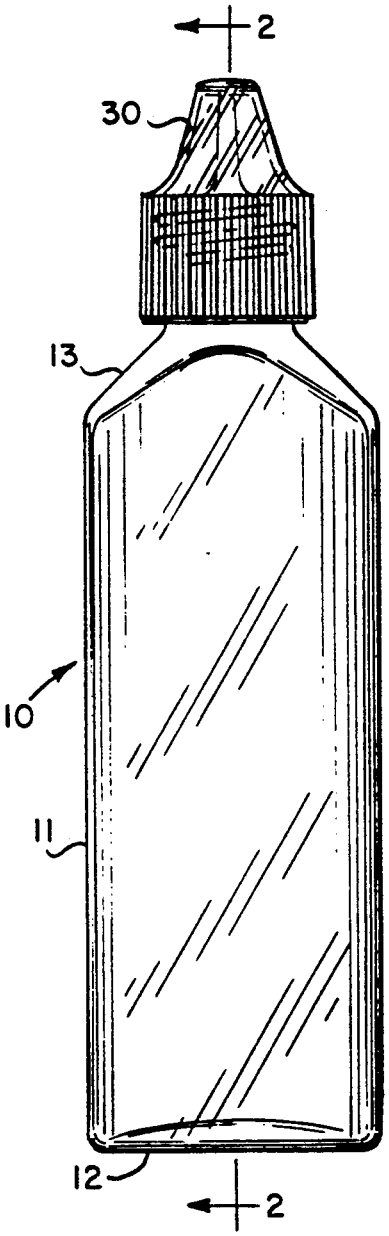
FIG. 1A is a front elevational view of the preferred embodiment of the bottle of the present invention, with a cap mounted onto the body of the bottle.
Figure 1B:
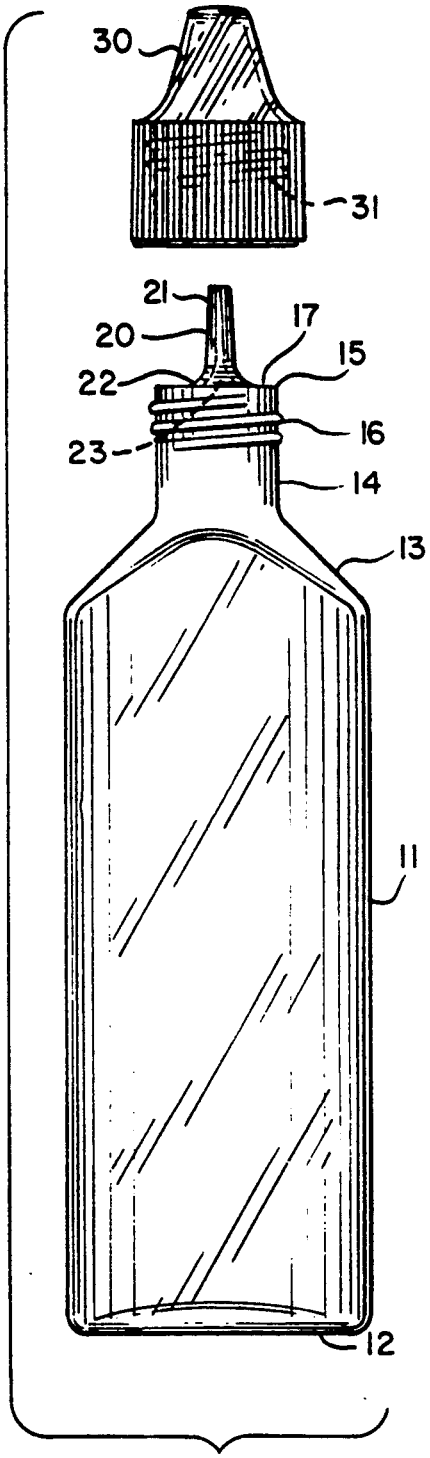
FIG. 1B is a front elevational view of the preferred embodiment of the bottle of the present invention, with a cap means removed from the body of the bottle.

Turning now to the figures, FIGS. 1A and 1B show a front view of a bottle 10, with and without a cap mounted, of the preferred embodiment of the present invention. Bottle 10 includes a resiliently deformable hollow body 11, having a base 12 at one end and sloped shoulders 13 at the other end. Shoulders 13 are angled toward each other, forming a neck 14 having an opening 15. A nozzle unit 20, comprising a substantially cylindrical elongate stem 21 sharply tapered to a flange 22, and having a passage 23 therethrouqh, is mounted in the opening 15. Stem 21 extends axially and outwardly from the flange 22. Lastly, a cap 30 is removably mountable on the neck 14, in a covering relationship to the nozzle unit 20.

The body 11 of bottle 10 is typically made from a resiliently deformable material, so that it may be manually compressed for forcing liquid from the interior through neck 14 and nozzle unit 20. Preferably, body 11 is molded from a resiliently deformable plastic, such as low density polyethylene (LDPE). It is most preferable to use a transparent plastic material to allow the user to easily determine the volume of liquid remaining in the bottle. Typically, body 11 is tubular with a substantially oval cross-section. Other cross-sectional shapes, however, may be used as may be apparent to those of skill in the art.

Base 12 typically is substantially flat, to enable bottle 10 to stand upright when not in use as an applicator and therefore prevent spills. In general, base 12 is shaped similarly to the cross-section of body 11, however, it may be shaped in any other configuration that would provide support to the bottle.

A pair of sloped shoulders 13, located at the opposite end of the body 11, are angled toward each other forming neck 14 having an opening 15. Neck 14 typically has a cylindrical shape, and has a cross-sectional diameter less than or equal to the narrowest part of the cross-section of body 11. Neck 14 is preferably centrally located atop the sloped shoulders 13 and is concentric with the body 11. Shoulders 13 are angled to prevent liquid build up and air pockets, to provide smooth flow from the bottle. Preferably, shoulders 13 are tapered toward the neck 14 at an angle of approximately 45°; however, the shoulders may be tapered at any angle sufficient to maintain smooth and even flow of a liquid from the bottle. In addition to providing smoother flow of a liquid from the bottle, sloped shoulders 13 provide for a clear line of sight between the user and the workpiece/-surface, thereby allowing for a more precise application of liquid.

Neck 14 includes a means for removably attaching a cap 30. Preferably, the means to removably attach cap 30 includes a series of spiralled threads 16 on the outer periphery of neck 14, which are mated by a series of opposing threads 31 located on the inside wall of cap 30. The opposing pairs of threads 16, 31 may be protruded or indented into the respective surfaces. Other means known to those skilled in the art to removably attach cap 30 may also be used, provided that a tight seal between cap 30 and body 11 is formed when the cap is attached and, the cap may be easily removed.

Nozzle unit 20 having passage 23 therethrough is mounted in opening 15 of neck 14. The nozzle unit 20 comprises two primary portions: an elongate stem 21 and a flange 22. Preferably, stem 21 is substantially cylindrical and extends axially and outwardly from the flange 22, which also has a cylindrical cross-section. As the nib-like stem 21 approaches flange 22 it is sharply tapered, such that the two portions appear to be substantially perpendicular. Preferably, the ratio of the cross-sectional diameters of stem 21 to flange 22 is between about 1:6 and about 1:7, thereby providing a fine controlled flow, and a clear line of sight, thereby allowing a more accurate application of liquid to a workpiece. Flange 22 is flush with the top 17 of the neck 14. In the preferred embodiment, the trumpet-like nozzle unit 20 is formed separately from the body 11 of bottle 10. Nozzle unit 20 is preferably molded from a clear plastic material to allow the user to observe the flow of a liquid from the bottle. Typically, nozzle unit 20 is press fit into the opening 15 of neck 14 after body 11 is filled with a desired liquid product. Other methods of attaching nozzle unit 20 to body 11, such as screw fitting, may also be used.

Cap 30 is removably mountable on neck 14 in a covering relationship to nozzle unit 20. As described above, cap 30 most preferably includes a series of spiralled threads 31 which are mated with opposing threads 16 located on the periphery of neck 14. Cap 30 is typically made from a rigid material which protects nozzle unit 20 from being damaged. Preferably, cap 30 is molded from a hard clear plastic, such as polycarbonate.

Figure 2:
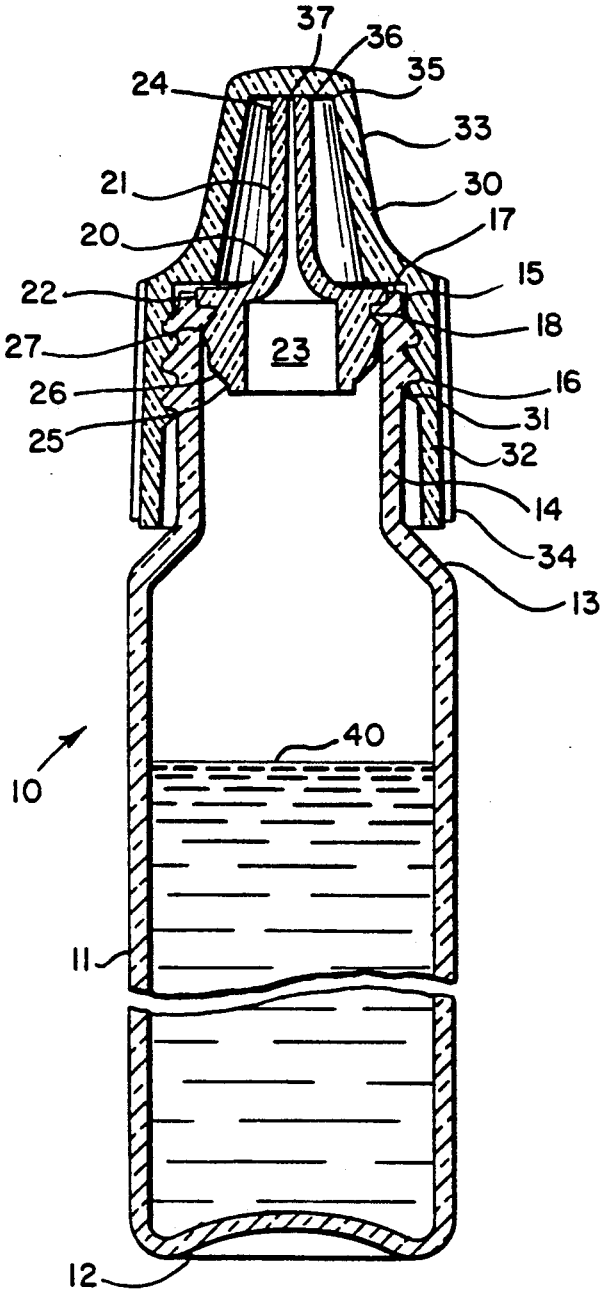
FIG. 2 is a cross sectional view, taken along line 2—2 of FIG. 1A.

Turning now to FIG. 2, there is illustrated an enlarged cross-sectional view (taken along line 2—2 of FIG. 1A) of the liquid applicator bottle 10 of the present invention. FIG. 2 illustrates, in greater detail, the covering relationship between nozzle unit 20, cap 30, and neck 14. Bottle 10 is shown with a liquid 40 in the body 11. Cap 30 is shown mounted to the neck 14. Cap 10 has a generally cylindrical portion 32 and conical portion 33. Spiralled threads 31 are provided on the inside of the cylindrical portion 32 to mate with opposing threads 16 provided on the outer periphery of neck 14. Preferably, the outer surface of the cylindrical portion 32 of cap 30 includes a series of ribs, or knurling, 34 to facilitate gripping of the cap during removal or fastening. In the preferred embodiment, the conical portion 33 of cap 30 includes, on an inside upper end portion 35, at least two dot-like projections 36, as further illustrated in FIG. 4. Dot-like projections 36 rest against the upper edge 24 of stem 21 of nozzle unit 20 when cap 30 is completely threaded onto neck 14. The projections 36 prevent stem 21 of nozzle unit 20 from contacting the inner upper end portion 35 of cap 30. A gap 37 is therefore formed between the upper edge 24 of stem 21 and the inner upper end portion 35 of cap 30, which prevents liquid 40 from building up and drying on the inner upper end portion 35 of cap 30, and/or plugging the upper edge 24 of stem 21. Preferably, four dot-like projections 36 are provided to prevent such contact. Other methods apparent to those skilled in the art may be used to prevent contact of stem 21 and cap 30.

Nozzle unit 20 has passage 23 therethrough, which extends from a nozzle base 25 through stem 21. Nozzle base 25 has a generally cylindrical shape, and is preferably designed to mate securely, by being press fit, with the inside surface of neck 14. Nozzle base 25 has a beveled tip 26 to facilitate insertion of nozzle unit 20 within neck 14. Nozzle base 25 also has an annular recess 27 for receipt of an annular projection 18, located on the inside surface of neck 14. Annular projection 18 projects inwardly a distance equal to the depth of annular recess 27. As a result of this configuration, nozzle unit 20 can be attached into neck 14 of bottle 10 by applying pressure until the annular projection 18 mates with the annular recess 27, forming a press fit. Nozzle unit 20 includes flange 22, which has a greater cross-sectional diameter than nozzle base 25. Flange 22 is located atop nozzle base 25, and defines the upper portion of annular recess 27. Nozzle unit 20 is concentric with cylindrical nozzle base 25, and tapers as it extends from flange 22 to the upper edge 24 of stem 21. Nozzle unit 20 may be ultrasonically or solvent welded after it is press-fit within neck 14. In another embodiment, nozzle unit 20 may be molded as part of body 11.

Figure 3:
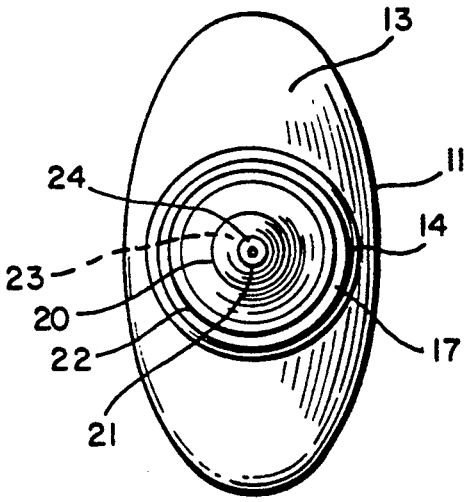
FIG. 3 is a top plan view of the bottle of the present invention, without a cap.

Referring now to FIG. 3, there is shown a top plan view of the bottle 10 of the present invention, without cap 30. FIG. 3 more clearly shows the cross-sectional shapes of body 11 and neck 14. In addition, the concentric alignment of passage 23, the upper edge 24 of stem 21 of nozzle unit 20 within neck 14, in which the maximum diameter of neck 14 is less than or equal to the narrowest part of the cross-section of body 11, is illustrated. Flange 22 of nozzle unit 20 is shown in, and flush with the top 17, of neck 14. Lastly, the sloped shoulders 13 are shown adjacent to neck 14.

Figure 4:
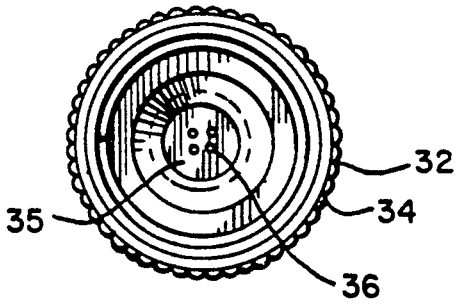
FIG. 4 is a bottom plan view of the cap.

FIG. 4 shows a bottom plan view of cap 30. Ribs, or knurling, 34 are provided on the outer periphery of the cylindrical portion 32 of cap 30 to facilitate removing the cap from, and fastening it onto, neck 14. On the inner upper end portion 35 of cap 30 the four dot like projections 36 are shown. As described above, projections 36 are useful in preventing liquid build up on cap 30 and/or plugging of the stem 14 portion of nozzle unit 20 by preventing contact of stem 14 with cap 30.

The foregoing detailed description has been given for clearness of understanding only, and unnecessary limitations ar not to be construed therefrom. The invention is not to be limited to the exact details shown and described since obvious modifications will occur to those skilled in the art, and any departure from the description herein that conforms to the present invention is intended to be included within the scope of the claims.

What is claimed is:

1. A liquid applicator bottle comprising:

a resiliently deformable hollow body adapted to hold a liquid and having a base at one end and sloped shoulders at the other end, said shoulders angled toward each other forming a neck having an opening;

a nozzle unit, having a passage therethrough, mounted in the opening neck, comprising an elongated stem at one end sharply tapered from a flange at the other end, said stem extending axially and outwardly from said flange, said flange retained within the opening of the neck; and cap means, removably mounted on said neck, in a covering relationship to said nozzle unit, said cap means including at least two projections on an inside upper end portion of said cap for preventing contact between said stem and said cap means.

2. The liquid applicator bottle of claim 1 wherein the hollow body is molded from a resiliently deformable transparent plastic material.

3. The liquid applicator bottle of claim 1 wherein the hollow body is made from low density polyethylene.

4. The liquid applicator bottle of claim 1 wherein the hollow body is tubular with a substantially oval cross-section.

5. The liquid applicator bottle of claim 1 wherein the base is substantially flat.

6. The liquid applicator bottle of claim 1 wherein the sloped shoulders are angled toward each other at an angle of approximately 45°.

7. The liquid applicator bottle of claim 1 wherein the neck has a cylindrical shape, and a cross-sectional diameter less than or equal to the cross-sectional diameter of the body.

8. The liquid applicator bottle of claim 1 wherein the neck has a means for removably mounting said cap means.

9. The liquid applicator bottle of claim 8 wherein said mounting means is a series of spiralled threads on the outer periphery of said neck.

10. The liquid applicator bottle of claim 1 wherein the elongated stem is substantially cylindrical.

11. The liquid applicator bottle of claim 10 wherein the substantially cylindrical stem, and the flange of the nozzle unit have a ratio of cross-sectional diameters between about 1:6 and 1:7.

12. The liquid applicator bottle of claim 1 wherein the nozzle unit is individually molded from a transparent plastic material.

13. The liquid applicator bottle of claim 1 wherein the cap means is molded from a rigid, transparent plastic material.

* * * * *